United States Patent [19]

Gauch et al.

[11] 4,325,196

[45] Apr. 20, 1982

[54] MULTILAYER IDENTIFICATION CARDS WITH RELIEF-LIKE SURFACE

[75] Inventors: Wolfgang Gauch, Otterfing; Joachim Hoppe; Yahya Haghiri-Tehrani, both of Munich, all of Fed. Rep. of Germany

[73] Assignee: G.A.O. Gesellschaft für Automation und Organisation mbH, Munich, Fed. Rep. of Germany

[21] Appl. No.: 121,886

[22] Filed: Feb. 15, 1980

Related U.S. Application Data

[63] Continuation of Ser. No. 861,420, Dec. 16, 1977, abandoned.

[51] Int. Cl.[3] ..... G09F 3/02

[52] U.S. Cl. ..... 40/2.2; 40/360; 428/156; 428/187; 428/211; 428/409; 428/915; 428/916; 428/513; 283/7; 283/8 R; 156/59; 156/108; 156/277; 156/583.1; 156/384; 156/209; 101/32

[58] Field of Search ..... 40/1.5, 2.2, 124.1, 40/360; 427/7; 428/915, 916, 409, 156, 187, 211, 913

[56] References Cited

U.S. PATENT DOCUMENTS

| | | | |
|---|---|---|---|
| 3,281,258 | 10/1966 | Callahan | 428/156 X |
| 3,287,839 | 11/1966 | Rotwein et al. | 40/2.2 |
| 3,313,052 | 4/1967 | Malster | 40/2.2 |
| 3,350,800 | 11/1967 | Witt et al. | 40/2.2 |
| 3,391,479 | 7/1968 | Buzzell et al. | 427/7 |
| 3,512,286 | 5/1970 | Siegel | 40/2.2 |
| 3,533,176 | 10/1970 | Weitzberg et al. | 40/2.2 |
| 3,537,195 | 11/1970 | Gerds | 40/2.2 |
| 3,566,521 | 3/1971 | Conner | 40/2.2 |
| 3,967,400 | 7/1976 | Otto | 40/2.2 |
| 4,031,640 | 6/1977 | Hanna et al. | 428/916 X |
| 4,057,919 | 11/1977 | Gauch et al. | 428/916 X |
| 4,066,873 | 1/1978 | Schatz | 40/2.2 X |

FOREIGN PATENT DOCUMENTS

| | | | |
|---|---|---|---|
| 2334702 | 7/1974 | Fed. Rep. of Germany | 428/915 |

*Primary Examiner*—P. Ives

*Attorney, Agent, or Firm*—McGlew and Tuttle

[57] ABSTRACT

A laminated multi-layer identification card comprising a plurality of individual layers connected to one another and having at least one outer surface which is directly contactable. At least one additional outer layer is laminated to the outer surface and covers a portion of the outer surface. The outer layer has a surface relief pattern in the form of intaglio printing which is directly accessible. The outer laminated layer may be made of paper and the remaining exposed outer surface not covered by the outer layer may be given a texture similar to that of paper so that the entire surface of the card feels like a paper-rough surface.

2 Claims, 4 Drawing Figures

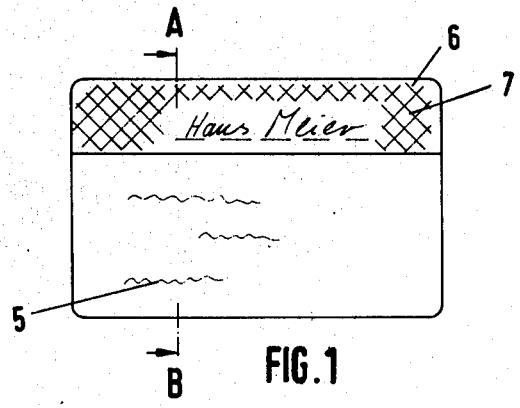
FIG. 1
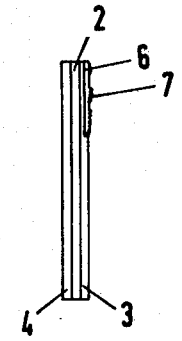
FIG. 2
FIG. 3
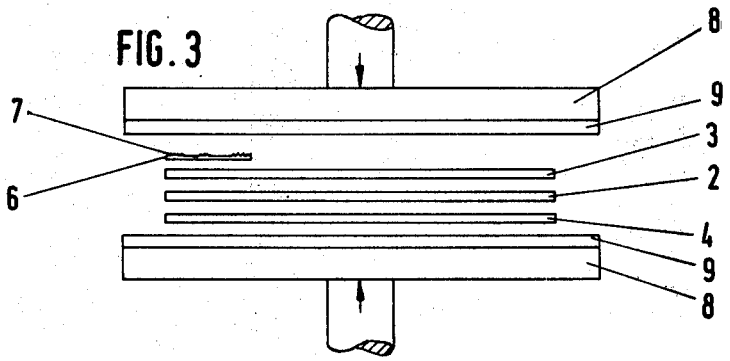
FIG. 4
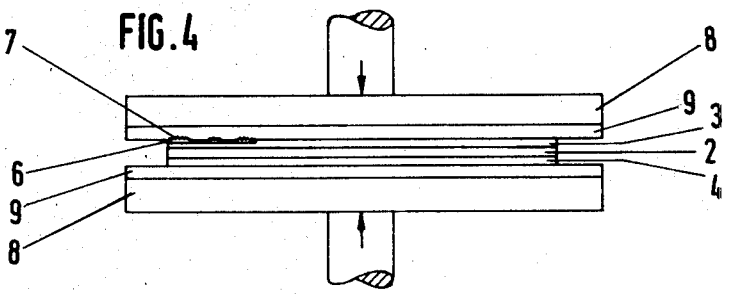

MULTILAYER IDENTIFICATION CARDS WITH RELIEF-LIKE SURFACE

This is a continuation of application Ser. No. 861,420 filed Dec. 16, 1977 now abandoned.

FIELD AND BACKGROUND OF THE INVENTION

The present invention relates to an apparatus for laminating multilayer identification cards which have relief-like surface.

For the manufacture of multilayer identification cards and the like, various methods are known. To manufacture identification cards with a planar surface, for example, use is made of two transparent films between which a paper blank is embedded on which all identification-card data, a passport photograph, and the like are imposed. In a single operation, the two outer layers and the information-carrying layer are so compressed under heat between two plane steel plates that the thermoplastic films, which become slightly pasty, penetrate into the pores of the paper and combine with the paper. Since the surfaces of the steel plates are planar, the surfaces of the identification cards become planar, too. Such cards with planar surfaces are very well suited for series manufacture, but their surfaces have no characteristics whatsoever which could prevent or show any attempted forgery and/or tampering thereof. In addition, the glossy card surface adversely affects the readability of the card data due to reflections under special lighting conditions.

To make it difficult to detach and reapply the transparent films, identification cards are known which have a raised seal, preferably in the picture or signature area. To manufacture such identification cards with raised patterns, the laminating apparatus is equipped with steel plates, for example, in which accurately positioned embossing dies are formed. Since the outer film become soft during the laminating process due to the applied heat, the embossing dies leave a permanent impression on the films (U.S. Pat. No. 3,533,176).

These identification cards have the disadvantage that, by reheating, the thermoplastic films can be "ironed" again and provided with new impressions at any time.

To avoid these disadvantages, identifications cards have been provided in which the paper blank is a security paper and in which the thickness differences of the paper blank, which are caused by watermarks, a safety thread, steel print, and the like, are visually, mechanically, and manually recognizable and detectable on the surface of the finished identification card. In such identification cards, the surface structure cannot be imitated by simple impression, and as a result of the manufacturing process being divided into different steps, subsequent attempts at lamination will be unsuccessful. Despite this very high safety against forgery and tampering, however, the wish for direct application to the card surface of similar raised patterns and particularly steel print has so far gone unfulfilled for lack of a suitable laminating technique. This is true particularly if signature strips provided with sensitive steel print or paper or film strips provided with similar relief print and intended for other purposes are to be laminated directly on to the surface of the identification card by a conventional laminating techniques. The inflexibility of the steel plates and the high laminating pressure damage the raised portions of the surface pattern in such a way that the quality of the identification cards so manufactured will not be satisfactory for the intended purpose of permitting easy verification of the authenticity of the card.

SUMMARY OF THE INVENTION

Accordingly, the object of the invention is to provide an apparatus for laminating multilayer identification cards which, besides making possible the known designs, permits counterfeit proof raised surface patterns to be applied directly to the outer card surface.

According to the invention, this object is achieved by inserting elastic intermediate laminating layers between the outer layers of the card and the hard laminating plates of the laminating apparatus.

A particular advantage of the apparatus according to the invention lies in the fact that, on the one hand, the raised surface patterns produced by steel printing or the like are fully preserved, while, on the other hand, the smooth, parallel areas of the card can have the quality of conventional cards. For example, laminated paper strips provided with relief print are sunk seamlessly into the thermoplastic outer film and are thus protected against manipulatory detachment without any damage to the relief print being perceptible.

Through the special surface finish of the elastic intermediate laminating layer according to the invention, a natural surface roughness can be produced on the layers covering the card. As a result of this surface roughness, the film surface is hardly distinguishable from the surface of a paper strip laminated on to the film. Identification cards of such design, in addition to giving a more homogeneous general impression, permit better data recognition since they are nonreflecting.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention is illustrated.

BRIEF DESCRIPTION OF THE DRAWINGS

An embodiment of the invention will now be explained in more detail with reference to the accompanying drawings, in which:

FIG. 1 is a top view of an identification card;

FIG. 2 is a section taken along line A–B of FIG. 1;

FIG. 3 is a schematic representation of the individual, superimposed layers of the identification card prior to lamination, and FIG. 4 is a schematic representation of the layers during lamination.

DESCRIPTION OF THE PREFERRED EMBODIMENTS

Identification and credit cards of PVC materials are manufactured almost exclusively in laminating installations, where the layers to be laminated are compression stationarily between laminating plates. The compressing methods are mostly aimed at producing smooth surfaces of the laminate which are achieved by covering the layers with planar, highly polished steel or hard-brass plates or chromium-plated steel plates, it being possible to laminate one or more layers. Experience has shown that the use of such cover plates during lamination guarantees a completely flawless film surface.

To preserve the raised surface pattern, the apparatus according to the invention starts from the fact that on each of the sides to be protected, an elastic intermediate layer (e.g. silicone) is inserted between the respective laminating plate and the layers to be laminated.

FIGS. 1 and 2 are top and sectional views, respectively, of an identification card made with the apparatus according to the invention. For the manufacture of the identification card of the invention, a paper blank 2 made from the point of view of compliance with requirements for securities is covered on both sides with films 3, 4. The surface of the upper cover film is provided with a paper element positioned relative to the printed matter 5 on the face of the blank and serving, for example, as a signature strip 6 for the subsequently laminated card. Instead of printing the signature strip by the conventional technique, i.e. surface printing, portions of this area are provided with steel print.

Steel printing can be done with commercially unavailable, but known printing machines as are used in the manufacture of bank notes. Very fine line patterns are printed on the surface of the paper in the manner of a relief. The relief 7 is formed by suitable color accumulations. Relief-like projections can also be obtained with other methods, e.g. by blind embossing of a paper.

The relief print obtained in either of the two aforementioned ways or by another technique producing the same effect must be so treated by a laminating technique with respect to its clearly visible and feelable relief effect that its structure is largely preserved after the lamination step, and the printing carrier (signature strip) must be sunk seamlessly into the film surface. The printing carrier to be embedded by lamination need not be of paper but may also be a film.

To preserve the relief-like structure of the steel print on the surface of the upper layer during the laminating process, according to the invention, a modified laminating cover plate is used for this surface (FIGS. 3 and 4). The laminating cover plates 8, 9 are designed so that the high compressive load placed by the laminating plate 8 on the relief-like surface 7 of the upper layer results in a uniform distribution of forces. This means that the application of forces is not only concentrated on the raised portions of the relief as is the case with the use of planar laminating cover plates made of steel or the like, but that the forces are applied uniformly over the entire relief surface. To accomplish this, a lamination plate of steel or hard brass is covered on one side with an approximately 0.5 to 2 mm thick silicone mat 9. This can be done by vulcanization or by bonding the silicone layer 9 to the plate with a thermally and pressure stable silicone adhesive. The mat may also be added without being attached. The mast has plane-parallel sides, and its surface structure is to be homogeneous.

To achieve dynamic adaptation of the silicone to the surface of the material to be laminated, the silicone advantageously has a medium Shore hardness. Preferred hardnesses range from 30 to 70 Shore.

By the use of silicone-covered laminating plates with a matt surface, the image of the surface structure of the silicone is produced on the surface of the laminate. This effect results in a matt, nonreflecting paper-like film surface. In addition, when viewing the paper blank lying below the film, a highly transparent impression is created.

To manufacture the silicone mat with a surface structure similar to that of paper, silicones are cast in sheet form, with an insert in the mold lined with paper. Upon being poured into the mold, the silicone adapts to the whole surface of the paper. After the silicone substance has set, an exact image of the paper structure is obtained on the surface of the silicone mat, so that after the lamination, almost no difference can be seen between the matt paper surface and the film surface.

While specific embodiments of the invention have been shown and described in detail to illustrate the application of the principles of the invention, it will be understood that the invention may be embodied otherwise without departing from such principles.

What is claimed is:

1. A laminated multi-layer identification card comprising:

a paper blank layer (2);

a top thermoplastic PVC layer (3) adhered under pressure to one surface of said blank layer;

a bottom thermoplastic PVC layer (4) adhered under pressure to an opposite surface of said paper blank layer; and a paper strip (6) having intaglio printing (7) on one surface thereof, which surface is adapted to receive a signature, adhered under pressure to an outer surface of one of said PVC layer (3), covering only a portion of said outer surface, with the plane of said one surface of said paper strip disposed in the plane of said outer surface of said one of said PVC layers.

2. A laminated multi-layer identification card comprising:

a paper blank layer (2);

a top thermoplastic PVC layer (3) adhered under pressure to one surface of said paper blank layer;

a bottom thermoplastic PVC layer (4) adhered under pressure to an opposite surface of said paper blank layer; and a paper strip (6) having intaglio printing (7) on one surface thereof, which surface is adapted to receive a signature, adhered under pressure to an outer surface of one of said PVC layers (3), covering only a portion of said outer surface, with the plane of said one surface of said paper strip disposed in the plane of said outer surface of said one of said PVC layers;

a remainder of said outer surface of said one of said PVC layers which is not covered by said paper strip having a paper-like surface roughness, said paper-like surface roughness being applied to said uncovered portion of said outer surface of said one of said PVC layers at the same time that said paper strip is adhered under pressure to said outer surface of said one of said PVC layers.

* * * * *